United States Patent [19]

Pensky et al.

[11] Patent Number: 4,635,548

[45] Date of Patent: Jan. 13, 1987

[54] RECIPROCATING PRINTER FOR PATCHES

[75] Inventors: Arnold H. Pensky, Fairlawn; James A. Hunt, Lodi, both of N.J.

[73] Assignee: Patchmaster Corp., West New York, N.J.

[21] Appl. No.: 793,726

[22] Filed: Oct. 31, 1985

Related U.S. Application Data

[63] Continuation-in-part of Ser. No. 641,873, Aug. 17, 1984, abandoned.

[51] Int. Cl.[4] ..... B41F 1/00

[52] U.S. Cl. ..... 101/319; 101/407 BP; 101/41

[58] Field of Search ..... 101/316, 318, 319, 320, 101/321, 323, 324–326, 310–312, 314, 315, 309, 301–303, 305, 298, 300, 295, 41, 44, 407 BP

[56] References Cited

U.S. PATENT DOCUMENTS

| | | | |
|---|---|---|---|
| 464,052 | 12/1891 | Ward et al. | 101/302 |
| 1,115,380 | 10/1914 | Beutler | 101/293 |
| 1,426,471 | 8/1922 | Fussell | 101/316 |
| 1,900,008 | 3/1933 | Baumgarten et al. | 101/320 |
| 2,144,849 | 1/1939 | Moore | 101/407 BP |
| 2,603,150 | 7/1952 | Klug | 101/320 X |
| 2,645,996 | 7/1953 | Krakenberg | 101/319 |
| 2,778,298 | 1/1957 | Russey | 101/319 X |
| 3,225,690 | 12/1965 | Saeger | 101/320 X |
| 3,543,681 | 12/1970 | Klenz | 101/292 X |
| 4,220,085 | 9/1980 | Schottle et al. | 101/316 |

FOREIGN PATENT DOCUMENTS

| | | | |
|---|---|---|---|
| 324429 | 1/1930 | United Kingdom | 101/319 |

*Primary Examiner*—Clifford D. Crowder
*Attorney, Agent, or Firm*—Robert A. Green

[57] ABSTRACT

Printing apparatus including a flexible support for a patch to be printed on and a vertical ram carrying type at its lower end. An inking roller is positioned to pass over the type with the type held up away from the patch to be printed on, and, after the inking roller has left the area of the type, the ram drives the inked type onto the patch. The ram is then raised, and the inking roller returns from being inked to a position where it can again ink the raised type to begin and repeat the printing operation.

7 Claims, 8 Drawing Figures

RECIPROCATING PRINTER FOR PATCHES

This is a continuation-in-part of co-pending Application Ser. No. 641,873 filed on Aug. 17, 1984, now abandoned.

BACKGROUND OF THE INVENTION

The present invention relates to apparatus for printing a name or message on a patch which is to be secured to a garment. The requirement may be for many patches, one patch, or a small number of patches carrying the same message, and each patch may have to be impressed two or three times to achieve the desired print quality.

Although there are multitudes of printing apparatus, there is no known apparatus of suitable simplicity and low cost to satisfy the requirements of the invention.

DESCRIPTION OF THE DRAWINGS

FIG. 4 is a plan view of a portion of the apparatus of FIG. 1 showing an adjustability feature;

FIG. 5 is a front elevational view of a portion of the apparatus of FIG. 1 showing an adjustability feature in another plane;

FIG. 6 is a side elevational view of a portion of the apparatus of FIG. 1 at one stage in its operation;

FIG. 7 is a side elevational view of a portion of the apparatus of FIG. 1 at another stage in its operation; and FIG. 8 is a schematic representation of an electronic circuit used to operate the apparatus of the invention.

DESCRIPTION OF THE INVENTION

Figure 1:
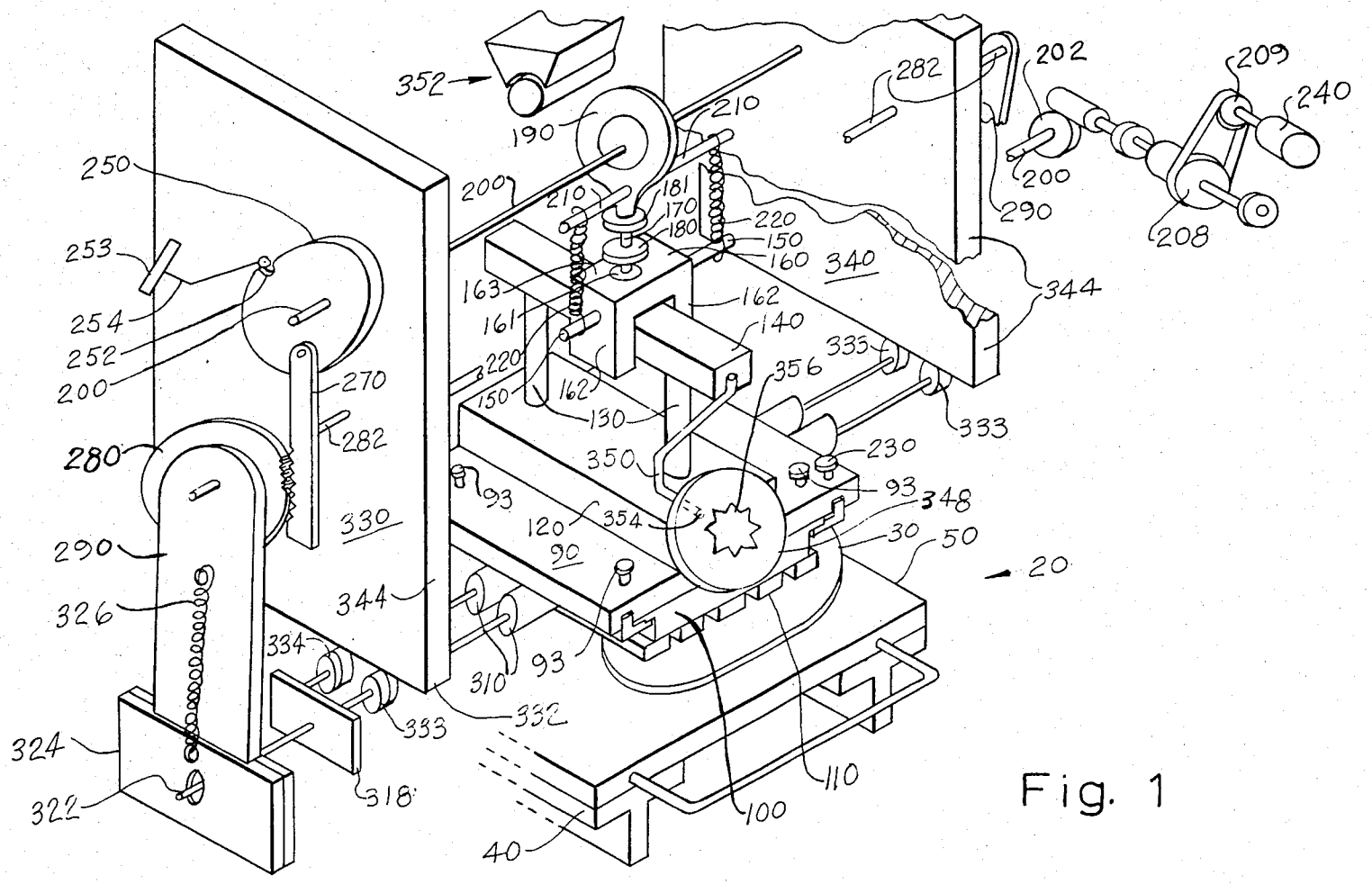
FIG. 1 is a plan view of printing apparatus embodying the invention.
Figure 2:
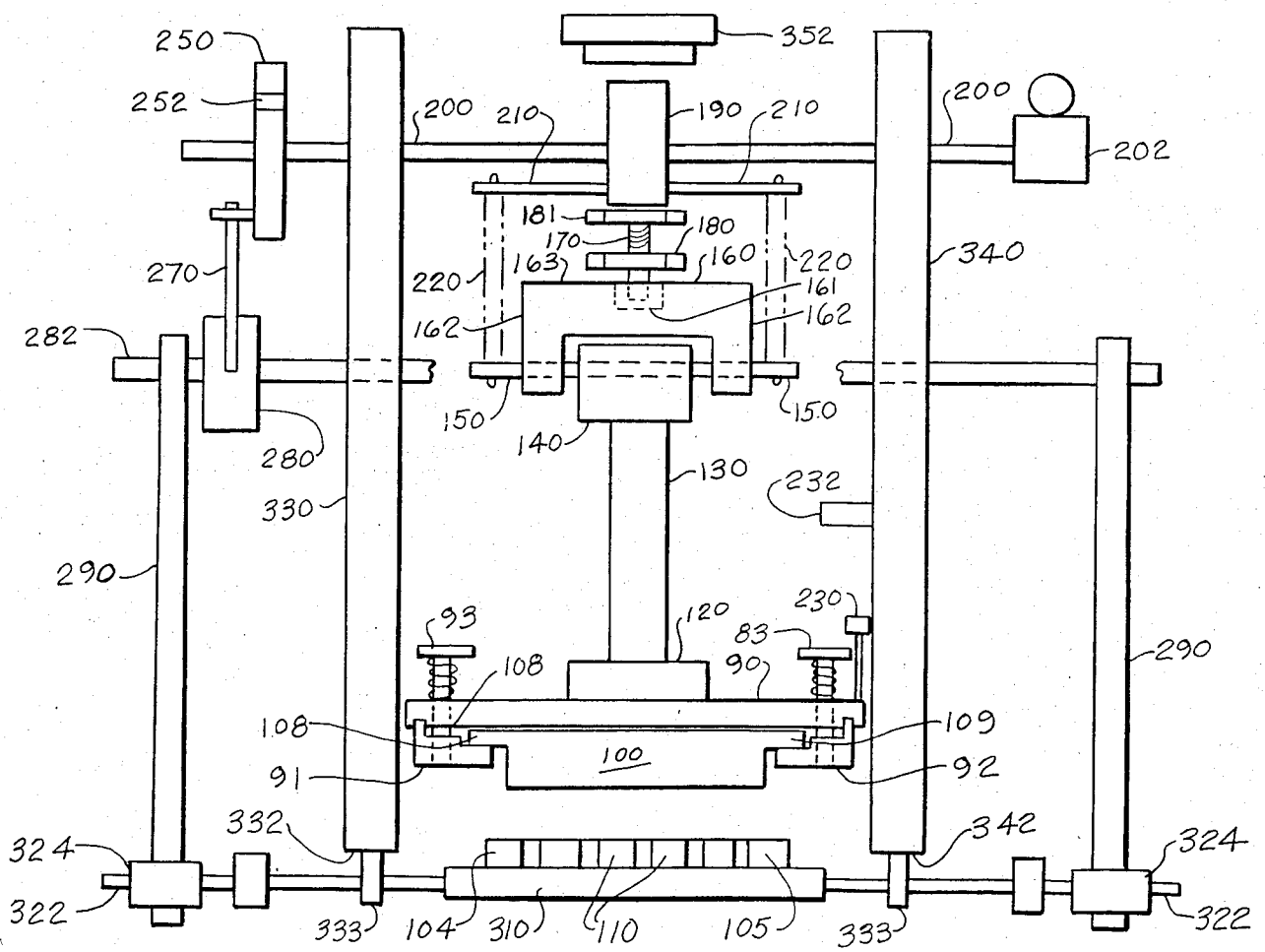
FIG. 2 is a front elevational view of the apparatus of FIG. 1.
Figure 3:
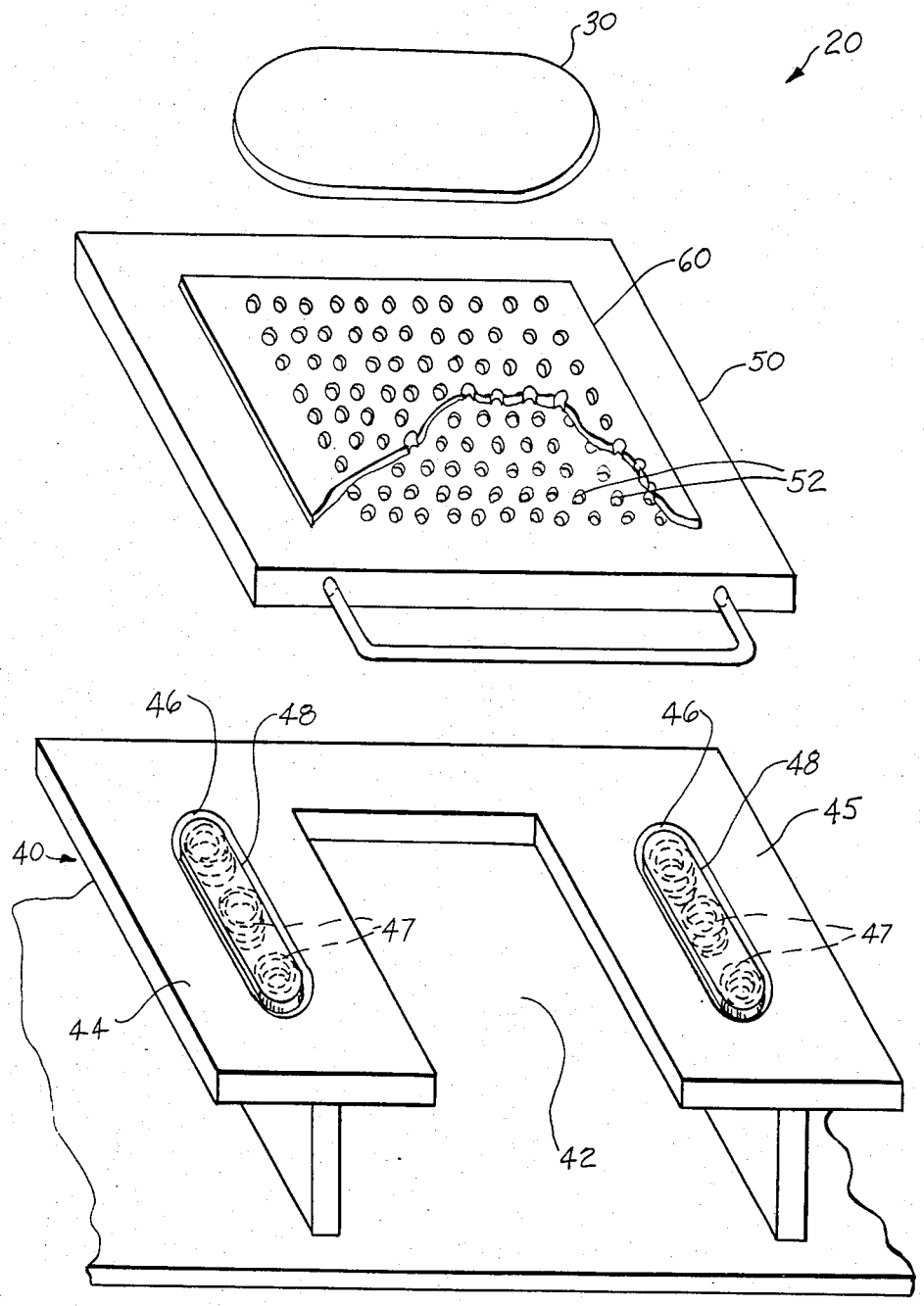
FIG. 3 is a perspective view of a portion of the apparatus of FIG. 1.

Printing apparatus 10 embodying the invention is mounted on a supported table and includes a support frame, only portions of which are shown and described. Referring to FIGS. 1, 2, and 3, the apparatus 10 includes a patch support assembly 20 for supporting a patch 30 on which a message is to be printed. The assembly includes a rigid horizontal metal plate 40 which is generally U-shaped and has a central opening 42 and two side arms 44 and 45. A slot or depression 46 is provided in each of the side arms, and a plurality of coil springs 47 are seated in the slots. A plate 48 is seated on the springs in each of the slots, and the plates 48 are thus resiliently supported.

A second plate 50, a patch support platen, is secured by welding or the like to the two plates 48 over the slots 46, and it is thus disposed in the proper desired physical relationship with respect to the other apparatus, to be described, to carry out the desired printing operation. The second plate has holes 52 in its top surface which communicate with an inner chamber which is connected by a suitable pipe or tube to a source of suction.

An apertured flexible, resilient sheet 60 of synthetic resinous material, a plastic, is seated on the top surface of the platen 50, and patches 30 to be printed on are placed on the second apertured sheet during the printing operation. Suction, acting through the apertures in the metal plate 50 and in the plastic sheet, holds down the patch during the printing operation. If desired, the apertures and suction can be omitted, and hold-down can be achieved by clamps secured to platen 50.

A vertical ram 80 is disposed above the patch support assembly 20 and carries at its lower end an assembly for carrying the type for the message to be printed on the patch 30. This assembly is suitably secured on the frame of the apparatus 10 and includes a horizontal metal plate 90 at the bottom of the ram.

Two metal side rails 91 and 92 are coupled to the lower surface of the ram plate 90 along the left and right sides thereof. The side rails are shaped to provide side channels 94 between the rails and plate 90. The rails 91 and 92 are secured to four posts 93 which are at the corners of plate 90 and which extend through holes in plate 90. The rails 91 and 92 are pulled upwardly by springs 96 on the shafts of the posts and pushing upwardly on the four posts.

The apparatus 10 includes a metal type chase 100 which carries the type 110 for performing the printing operation. The chase is a generally rectangular tray and includes left and right side walls 106, 107 having left and right horizontally projecting arms 108, 109 which slide into the channels 94, and the springs pulling up on rails 91 and 92, cause the chase to be held securely in plate by the rails.

Elongated metal bars or tracks 104, 105, rectangular in cross-section, are secured to and extend along the lower edges of the left and right side walls 106, 107 of the type chase 100. The lower outer surfaces of the tracks 104, 105 are flat and generally coplanar with the surfaces of the type 110 held in the chase, for a purpose to be described.

It is noted that the resilient mounting of the print patch 30 on the plastic sheet 60 and on the springs 47 in slots 46 permits the apparatus to compensate for type 110 of different heights to provide good, uniform print quality of all portions of a message.

The ram 80 includes a large metal block 120 secured to the top surface of plate 90, and two parallel rods 130 are secured to the block and extend vertically therefrom in suitable slide bearings (not shown), and they are secured at their upper ends to a horizontal metal block 140.

The block 140 carries a horizontal shaft 150 which extends laterally from both sides thereof. A U-shaped metal block 160 is coupled to the horizontal block 140 by having its arms 162 pivotably supported on the shaft 150. A vertical threaded post 170 extends upwardly from the U-shaped block 160 which has a vertical hole 161 in its top surface 163 in which the lower end 171 (FIG. 2) of the threaded shaft is slidably inserted. The upper end of the threaded shaft 170 is screwed into the lower end of a crank 190 by means of a fixed nut 180 which is integral therewith and it is held in place by a threaded jam nut 181. A horizontal drive shaft 200 is secured to the crank and extends laterally therefrom.

A pair of posts 210 extend laterally from the crank 190, and two coil springs 220 are secured between the posts and the shaft 150. The springs serve to pull the ram 80 upwardly so that an adjustable screw 230 carried by the plate 90 butts up against bracket 232 secured to the frame of the apparatus. This holds the chase 100 up while inking rollers to be described perform an inking function on the type.

The drive shaft 200 extends laterally, and, at one end, it is coupled through a worm gear 202 and worm 204, clutch 206, and chain-coupled gears 208 and 209 to a motor 240, and, at the other end, it carries a cam disk 250. The cam disk 250 has a notch 252 in its periphery, and a microswitch 253 has the end of the arm 254 positioned to drop into the notch 252 and open the switch. Near the periphery of cam 250 is pivotably secured a vertical rack 270 which is coupled to a pinion gear 280 secured to a horizontal shaft 282. Shaft 282 extends laterally so that it is accessible at both sides of apparatus 10. An elongated bar 290 is secured to each end of the shaft 282 at the sides of apparatus 10, and they rotate with the gear 280 and shaft 282. At the lower end of the bars 290, they are coupled to and drive an inking roller assembly in a manner to be described.

The inking roller assembly includes two shafts 300 carrying ink rollers 310 having surfaces of fabric, rubber, or the like which can pick up ink from an ink palette. The roller shafts 300 carry ball bearings 333 and are rotatably mounted at their ends in brackets or plates 318, and each plate 318 has a projecting pin 322. A U-shaped bracket 324 is slidably mounted on the lower end of bar 290 and has a slot 325 through which pin 322 extends. A suitable slot is also provided but not shown in bar 290. A spring 326 is coupled between a post on bar 290 at an upper portion thereof and a post on U-shaped bracket 324. Spring 325 pulls U-shaped bracket 324 upwardly, and the bracket pulls pin 322 and the inking roller assembly upwardly as required for a purpose to be described below. The coupling described above is such that pivoting of bars 290 drives the inking rollers along a path to be described.

The frame of apparatus 10 includes parallel left and right side plates 330 and 340 which are vertically oriented. The plates 330 and 340 include coplanar lower horizontal edges 332 and 342 which run from back to front at about the level of the type chase 100. The horizontal edges lead through a smoothly curved portion to a generally vertical edge 334, 344 which runs upwardly along the apparatus 10. At an upper portion of the assembly 10, a disk 348 is provided which is used as a printing palette which can be inked by hand or from an ink well 352. The disk is disposed with its surface vertical at the front of the apparatus and facing away from the apparatus. The inking roller assembly is disposed so that the ball bearings 334 on the shafts 300 of the inking rollers are in contact with the lower horizontal edges 332, 342 of the side plates 330, 340.

The inking rollers, at their ends, are in contact with the surfaces of the tracks 104, 105, rearwardly, behind the type in the chase 100. Thus, at the beginning of a printing operation, as the inking rollers begin to move, they are caused to roll by their contact with the tracks, and they are kept rolling as they touch the type, and this produces a favorable transfer of ink from the rollers to the type before a printing operation is performed.

To the front end of bar 140 is secured a vertical rod 350, the lower end of which is provided with a hook-like process 354 which engages a gear 356 secured to the rear surface of palette disk 348. Movement of the ram 80 up and down causes the rod 350 and its hook end engaging the palette gear to rotate the palette little by little to insure good, uniform ink distribution on its surface. The surface of the palette is provided with ink as required during operation of the apparatus 10.

Briefly, in operation of the apparatus 10 and referring to FIGS. 6 and 7, with the crank 190 at dead center and the inking roll assembly held retracted at the rear end of the apparatus, behind the type chase 100, the springs 220 hold the lower portion of the ram up with screw 230 against the bar 232. This is permitted by the pivot connection between the U-shaped block 160 and the block 140.

As the crank 190 is rotated by motor 240, the rack 270 and gear 280 cause bars 290 to drive the inking rollers 310 forward, and, after they have moved forward across the type 110 and deposited ink thereon, the crank 190 reaches a position where it begins to force the ram 80 and type 110 downardly onto the patch 30. Continued rotation of the crank shaft drives the rack and gear to drive the ink rollers upwardly along the side frames 330 and 340 to pass over the palette 348, pick up ink, and start down along the same path to their initial rearward position. After the crank 190 passes a pre-selected point, the ram 80 starts back up and the springs 220 pull the type away from the patch, and the inking rollers move back across the type to deposit ink thereon to their starting position behind the type.

The printed patch 30 can then be removed, another patch inserted, and the operation repeated.

It is noted that the parts are arranged so that the switch arm 254 drops into the notch 252 in the cam disk 250 and turns off the printer when the crank 190 is at top dead center.

If desired, the electrical controls which operate the apparatus 10 can be programmed to provide multiple impressions of the same message on one patch.

It is desirable to provide means for physically adjusting the printing apparatus 10, and in one arrangement, two tracks are provided on the frame 478 for adjusting the position of the apparatus both up and down and front to rear. As shown schematically in FIGS. 4 and 5, the side frames 330 and 340 (not shown) have vertical slots 480 in their rear surfaces which receive vertical projecting bars 484 on frame 478, by which means the side plates 330 and 340 and the apparatus they carry can be adjusted up and down. Similarly, the side frame 478 carries horizontal slots 482 which receive horizontal bars 486 on the rear surfaces of the left and right side plates 330 and 340, by which means, front to back adjustment is made.

An electrical circuit 370 for operating the printing apparatus 10 is shown in FIG. 8 and includes two buses 380 and 390 connected to the conventional 120 volt A.C. power supply. The motor 240 and a motor-on-off switch 400 are connected between the lines 380 and 390. The circuit also includes two switches, one of which is a microswitch 253 associated with cam disk 280 (having arm 254) and one terminal connected to lead 410 and a second terminal connected to an electric counter coil 257 of count switch 256. The other switch is count switch 256, which is connected to line 410 which runs from one contact 420 of a two-contact switch 450 to the contact 430 of a run switch 432. The contact arm 440 of the run switch is connected to the contact arm of the switch 450 and through the clutch release coil 460 of the motor 240 to the line 390. The other contact 470 of the switch 450 is connected to the other line 380.

As part of the electrical system, the cam disk 250 has a notch 252 in its periphery, and switch arm 254 of switch 252 is positioned adjacent to it, and an impression count is registered each time the disk 250 goes around and the arm 254 falls into the notch. The arm and switch generate counting pulses. In addition, the parts are arrayed so that, when arm 254 drops into notch 252, the microswitch opens and the crank stops at dead center on the upper end of its stroke.

In operation of the circuit 370, switch 400 is closed to permit the motor to run constantly. The count switch is closed by setting the counter to the desired number of impressions to be made. The run switch 432 is then closed to energize the clutch 206 and start the press to perform the desired number of imprints. When the count switch 256 opens, the press stops. The operator opens switch 432 before setting the count switch for the next operation.

What is claimed is:

1. Printing apparatus comprising parallel vertical left and right side plates which face each other;

a first horizontal rotatable shaft extending across the printing apparatus at the upper end thereof and through said left and right side plates to provide left and right ends beyond said left and right side plates, respectively;

a drive motor coupled to said first shaft, left and right cam disks secured near the left and right ends of said first horizontal shaft to the left and to the right of said left and right side walls, respectively;

a control switch adjacent to and operable with the notch in one of said cam disks;

left and right vertical racks pivotably secured at one end to said left and right cams, respectively;

a second horizontal shaft, positioned vertically below said first shaft, and extending across the printing apparatus and said left and right side plates to provide left and right ends disposed beyond said left and right side plates, respectively;

a left and right pinion gear secured to the left and right ends of said second horizontal shaft and coupled to the left and right racks, respectively;

left and right vertical bars secured at their upper ends to the left and right ends of said second horizontal shaft;

left and right apertured brackets slidably mounted on the left and right vertical bars, respectively, at the lower ends thereof;

a spring coupled between each apertured bracket and its vertical bar to pull the apertured bracket upwardly on the vertical bar;

an inking roller assembly comprising two horizontal rollers rotatably mounted on inking roller shafts, the ends of said inking roller shafts being secured to a left bracket and a right bracket, left and right horizontal posts extending from said left and right brackets, respectively, and lying in the apertures in said left and right apertured brackets, respectively, and left and right starting rollers rotatably mounted on said inking roller shafts and engaging said left and right side plates;

a crank mounted on said first horizontal shaft;

a horizontal upper pin extending to the left and right from said crank;

a vertical shaft depending from said crank;

a U-shaped block slidably mounted on the lower end of said vertical shaft and disposed with its legs generally parallel to the left and right side plates;

a horizontal elongated bar pivotably coupled between the legs of said U-shaped block and oriented front to rear of the printing apparatus;

a horizontal lower pin extending from left to right through said U-shaped bracket and through said elongated bar;

a pair of springs coupled between said upper and lower horizontal pins and tending to pull said U-shaped block and said horizontal elongated bar upwardly;

a pair of vertical posts secured to said elongated bar and depending downwardly therefrom;

means secured to said vertical posts for holding a type chase and printing type in position to perform a printing operation;

said inking rollers being positioned in contact with said last-named means, normally to the rear thereof and out of contact with the printing type;

a support for a sheet to be printed on by said type including a plate support, a resilient sheet, and a sheet to be printed on disposed facing said type; and an ink pad secured to said elongated bar above said type chase;

all of said parts being so positioned that, at the beginning of a cycle of operation when the motor starts to turn said first shaft and said crank, and before a printing operation is performed, said pair of springs holds said means and said printing type up away from said sheet to be printed on while said inking rollers move from rearwardly of said type across said type to apply ink thereto and forwardly, with said starting rollers riding along the edges of said left and right side plates and causing rotation of said inking rollers, said crank then forcing the parts to which it is coupled including the type chase and type downwardly to contact said sheet to be printed on and printing a message thereon.

2. The printing apparatus defined in claim 1 wherein said patch support includes, in order, a base support including springs in its top surface, a patch support plate on said base support and seated on said springs, a thin sheet of flexible material on said patch support plate, a blank patch seated on said sheet of flexible material in position to be printed on, and means for holding said blank patch down on said flexible sheet.

3. Printing apparatus comprising parallel vertical left and right side plates which face each other;

a first horizontal rotatable shaft extending across the printing apparatus at the upper end thereof and through said left and right side plates to provide left and right ends beyond said left and right side plates, respectively;

a drive motor coupled to said first shaft;

a mechanical motion transmitting assembly secured to the left and right ends of said first horizontal shaft;

a crank mounted on said first horizontal shaft between said left and right side plates;

a vertical shaft depending from said crank;

a flexible coupling coupled to and depending from said vertical shaft and including a U-shaped block having two spaced-apart legs and a horizontal bar pivotably coupled to said U-shaped block and positioned between the legs of said block;

springs coupled between said crank and said U-shaped block and urging said U-shaped block upwardly;

a post extending downwardly from said horizontal bar;

a type chase and printing type secured to said post;

a flexible support, for a sheet to be printed on, disposed beneath and spaced from said type;

inking rollers coupled to and driven by said mechanical motion transmitting assembly from rearwardly of said printing type and across said printing type to forwardly of said printing type;

the operation of the apparatus being: (1) as the crank begins its cycle of operation, it starts to rotate said first shaft and to drive said post and type downwardly toward the sheet to be printed on, but initially said springs, operating by means of said flexible coupling, hold said post and type up and prevent their downward movement; (2) during this time, the inking rollers move from behind said type, across said type to deposit ink thereon, and forwardly beyond said type, the rollers as they move being guided on said left and right side plates; (3) continued movement of the crank through its cycle of operation reaching a point at which it overcomes the effect of said springs and drives the post and type downwardly to perform a printing operation; (4) return of the crank to its starting position and raising said post and type and said inking rollers return to their starting position behind said type.

4. Printing apparatus comprising parallel vertical left and right side plates which face each other;

a first horizontal rotatable shaft extending across the printing apparatus at the upper end thereof and through said left and right side plates to provide left and right ends;

a drive motor coupled to said first shaft;

left and right cam disks secured near the left and right ends of said first horizontal shaft;

a control switch adjacent to and operable with one of said cam disks;

left and right vertical racks pivotably secured at one end to said left and right cams, respectively;

a second horizontal shaft, positioned vertically below said first shaft, and extending across the printing apparatus and said left and right side plates to provide left and right ends;

a left and right pinion gear secured to the left and right ends of said second horizontal shaft and coupled to the left and right racks, respectively;

left and right vertical bars secured at their upper ends to the left and right ends of said second horizontal shaft;

left and right apertured brackets slidably mounted on the left and right vertical bars, respectively, at the lower ends thereof;

a spring coupled between each apertured bracket and its vertical bar to pull the apertured bracket upwardly on the vertical bar;

an inking roller assembly comprising a rotatable horizontal inking roller mounted on an inking roller shaft, the ends of said inking roller shaft lying in the apertures in said left and right apertured brackets, respectively, and left and right starting rollers rotatably mounted on said inking roller shaft and engaging said left and right side plates;

a crank mounted on said first horizontal shaft;

a horizontal upper pin extending to the left and right from said crank;

a vertical shaft depending from said crank;

a U-shaped block mounted on the lower end of said vertical shaft and disposed with its legs generally parallel to the left and right side plates;

a horizontal elongated bar pivotably coupled between the legs of said U-shaped block and oriented front to rear of the printing apparatus;

a horizontal lower pin extending from left to right through said U-shaped block and through said elongated bar;

a pair of springs coupled between said upper and lower horizontal pins and tending to pull said U-shaped block and said horizontal elongated bar upwardly;

a pair of vertical posts secured to said elongated bar and depending downwardly therefrom;

means secured to said vertical posts for holding a type chase and printing type in position to perform a printing operation;

said inking roller being positioned in contact with said last-named means, normally to the rear thereof and out of contact with the printing type;

a support for a sheet to be printed on by said type including a plate support, a resilient sheet, and a sheet to be printed on disposed facing said type; and an ink pad secured to said elongated bar above said type chase;

all of said parts being so positioned that, at the beginning of a cycle of operation when the motor starts to turn said first shaft and said crank, and before a printing operation is performed, said pair of springs holds said means and said printing type up away from said sheet to be printed on while said inking roller moves from rearwardly of said type across said type to apply ink thereto and forwardly, with said starting rollers riding along the edges of said left and right side plates and causing rotation of said inking roller, said crank then forcing the parts to which it is coupled including the type chase and type downwardly to contact said sheet to be printed on and printing a message thereon.

5. Printing apparatus comprising parallel vertical left and right side plates which face each other;

a first horizontal rotatable shaft extending across the printing apparatus at the upper end thereof and through said left and right side plates to provide left and right ends;

a drive motor coupled to said first shaft;

a cam disk secured to one end of said first horizontal shaft;

a vertical rack pivotably secured to said cam disk;

a second horizontal shaft, positioned vertically below said first shaft, and extending across the printing apparatus and said left and right side plates to provide left and right ends;

a pinion gear secured to one end of said second horizontal shaft and coupled to said rack;

a vertical bar secured at its upper end to one end of said second horizontal shaft;

an apertured bracket slidably mounted on said vertical bar at the lower end thereof;

a spring coupled between said apertured bracket and said vertical bar to pull the apertured bracket upwardly on the vertical bar;

an inking roller assembly comprising a horizontal roller rotatably mounted on an inking roller shaft, the ends of said inking roller shaft being positioned in the aperture in said apertured bracket; and left and right starting rollers, rotatably mounted on said inking roller shaft and engaging said left and right side plates;

a crank mounted on said first horizontal shaft;

a horizontal upper pin extending to the left and right from said crank;

a vertical shaft depending from said crank;

a U-shaped block mounted on the lower end of said vertical shaft and disposed with its legs generally parallel to the left and right side plates;

a horizontal elongated bar pivotably coupled between the legs of said U-shaped block and oriented front to rear of the printing apparatus;

a horizontal lower pin extending from left to right through said U-shaped block and through said elongated bar;

a pair of springs coupled between said upper and lower horizontal pins and tending to pull said U-shaped block and said horizontal elongated bar upwardly;

a pair of vertical posts secured to said elongated bar and depending downwardly therefrom;

means secured to said vertical posts for holding a type chase and printing type in position to perform a printing operation;

said inking roller being positioned in contact with said last-named means, normally to the rear thereof and out of contact with the printing type;

a support for a sheet to be printed on by said type including a plate support, a resilient sheet, and a sheet to be printed on disposed facing said type; and an ink pad secured to said elongated bar above said type chase;

all of said parts being so positioned that, at the beginning of a cycle of operation when the motor starts to turn said first shaft and said crank, and before a printing operation is performed, said pair of springs holds said means and said printing type up away from said sheet to be printed on while said inking roller moves from rearwardly of said type across said type to apply ink thereto and forwardly, with said starting rollers riding along the edges of said left and right side plates and causing rotation of said inking roller, said crank then forcing the parts to which it is coupled including the type chase and type downwardly to contact said sheet to be printed on and printing a message thereon.

6. Printing apparatus comprising parallel vertical left and right side plates which face each other;

a first horizontal rotatable shaft extending across the printing apparatus at the upper end thereof and through said left and right side plates to provide left and right ends beyond said left and right side plates, respectively;

a drive motor coupled to said first shaft;

a crank mounted on said first shaft and positioned between said left and right side plates;

a ram assembly coupled to said crank and disposed between said side plates and adapted to move down and up;

a type holder and printing type secured to the lower end of said ram assembly; and a support plate supporting a sheet to be printed on beneath said type;

said ram assembly including a flexible coupling made up of (1) a U-shaped block secured to the crank and (2) a bar pivotably coupled to the U-shaped block and secured to said type holder;

said ram assembly including spring means for holding said ram up against a mechanical stop while said type is inked before a printing operation is performed at the beginning of a printing cycle and while said crank is moving from its starting position to its printing position;

at a selected position in its cycle of operation, said crank overcoming the action of said spring and driving said ram and said type downwardly to perform a printing operation.

7. Printing apparatus comprising a flexible support for a sheet to be printed on;

a vertical ram assembly and means for reciprocating the ram assembly up and down away from and toward said flexible support;

said ram assembly including a flexible coupling made up of a U-shaped block and a bar pivotably coupled to the U-shaped block, printing type held at the lower end of said ram and secured to said bar, said type facing said flexible support;

inking roller means; and mechanical drive means for said ram assembly including a crank secured to said U-shaped block and driving said ram downwardly from a starting position, at which said inking roller means is positioned rearwardly of said type and it begins to move toward said type, and spring means holding said ram and type up against a stop while said inking means moves forwardly across said type, said crank being arranged to drive the ram and type downwardly after said inking rollers have passed over the type and moved to a position in front of the type.

* * * * *